US005528646A

United States Patent [19]

Iketaki et al.

[11] Patent Number: 5,528,646

[45] Date of Patent: Jun. 18, 1996

[54] SAMPLE VESSEL FOR X-RAY MICROSCOPES

[75] Inventors: Yoshinori Iketaki, Oume; Shoichiro Mochimaru, Hachiouji; Yoshiaki Horikawa, Hachiouji; Komei Nagai, Hachiouji, all of Japan

[73] Assignee: Olympus Optical Co., Ltd., Tokyo-to, Japan

[21] Appl. No.: 425,233

[22] Filed: Apr. 18, 1995

Related U.S. Application Data

[63] Continuation of Ser. No. 112,143, Aug. 26, 1993, abandoned.

[30] Foreign Application Priority Data

| | | | |
|---|---|---|---|
| Aug. 27, 1992 | [JP] | Japan | 4-228951 |
| Aug. 27, 1992 | [JP] | Japan | 4-228952 |
| Jul. 23, 1993 | [JP] | Japan | 5-182925 |

[51] Int. Cl.[6] ..... G21K 7/00

[52] U.S. Cl. ..... 378/43; 422/102; 422/104

[58] Field of Search ..... 422/102, 104; 378/34, 35, 43, 45, 84, 85, 161, 208, 210

[56] References Cited

U.S. PATENT DOCUMENTS

| | | | |
|---|---|---|---|
| 4,538,291 | 8/1985 | Iwamatsu | 378/119 |
| 4,693,933 | 9/1987 | Keem et al. | 428/333 |
| 5,003,567 | 3/1991 | Hawryluk et al. | 378/34 |
| 5,022,064 | 6/1991 | Iketaki | 378/145 |
| 5,107,526 | 4/1992 | Hoover | 378/43 |
| 5,131,023 | 7/1992 | Yasugaki et al. | 378/43 |
| 5,132,994 | 7/1992 | Kato | 378/43 |
| 5,163,078 | 11/1992 | Iketaki | 378/85 |
| 5,177,774 | 1/1993 | Suckewer et al. | 378/43 |
| 5,216,699 | 6/1993 | Iketaki | 378/43 |
| 5,222,113 | 6/1993 | Thieme et al. | 378/43 |

FOREIGN PATENT DOCUMENTS

| | | |
|---|---|---|
| 63-298200 | 12/1988 | Japan . |
| 63-298200 | 12/1988 | Japan . |
| 3197838 | 8/1991 | Japan . |
| 3197836 | 8/1991 | Japan . |
| 5264738 | 10/1993 | Japan . |
| 1172327 | 11/1969 | United Kingdom . |

OTHER PUBLICATIONS

Niemann et al, X–ray Microscopy with Synchrotron Radiations, Aug. 1976, vol. 15, No. 8, Applied Optics, pp. 1883–1884.

Seward et al, Calibrated "Four–Color" X–ray Microscope for Laser Plasma Diagnostics, Rev. Sci Instrum. vol. 47, No. 4, Apr. 1976, pp. 464–470.

*Primary Examiner*—James C. Housel
*Assistant Examiner*—Harold Y. Pyon
*Attorney, Agent, or Firm*—Cushman, Darby & Cushman

[57] ABSTRACT

A sample vessel for X-ray microscopes comprising a first silicon base plate having an entrance window covered with a thin film of silicon nitride, and a second silicon base plate which has an exit window covered with a thin film of silicon nitride and matched with the entrance window. The second silicon base plate being connected the first base plate by way of a spacer so as to form a sealed space capable of accommodating samples to be observed. Disposed in the space is a mesh member made of a wire material having an angle of contact with water smaller than 90° at a location adjacent to the thin film of silicon nitride covering the entrance window or a thin film of aluminium is evaporation-coated over the thin film of silicon nitride. This sample vessel makes it possible to enhance mechanical strength of the thin film of silicon nitride and limits shifting of samples within very narrow ranges with water films formed in meshes of the mesh member, thereby remarkably facilitating observation of the samples with X-rays and soft X-rays.

18 Claims, 6 Drawing Sheets

FIG. 1B(1) PRIOR ART

FIG. 1B(2) PRIOR ART

SAMPLE VESSEL FOR X-RAY MICROSCOPES

This is a continuation of application Ser. No. 8/112,143, filed on Aug. 26, 1993, which was abandoned upon the filing hereof.

BACKGROUND OF THE INVENTION a) Field of the Invention

The present invention relates to a sample vessel for X-ray microscopes, and more specifically to a vessel which is to be applied to microscopy using light sources emitting X-rays or soft X-rays and configured so as to be capable of containing samples to be observed together with an aqueous solution.

b) Description of the Related Art

In recent years remarkable progress has been made in research and development of light sources emitting X-rays and optical elements for X-rays. X-ray microscopes are offered as commercial products which have been obtained as one kind of systems developed by utilizing the progress. These X-ray microscopes are of various types which utilize imaging means such as a grazing incidence optical system of a Walter type (FIG. 1A), a Fresnel zone plate utilizing diffraction (FIG. 1B) and a direct incidence type Schwarzschild optical system comprising two spherical mirrors coated with multi-layer films (FIG. 1C).

Shown in FIG. 1A are Hyperboloids of revolution HR, reflecting surfaces RS, an object point OP, an Image point IP, and an ellipsoid of Revolution ER. Shown in FIG. 1B(2) are a Focal point of virtual Image VI, a Focal point of a real image RI, and a zone plate AP. Shown in FIG. 1C are an Image point Ip and an object point op.

It is known that these X-ray microscopes have spatial resolution which is ten times or more higher than that of the ordinary optical microscopes using the visible rays owing to a fact that the X-ray microscopes have limits of diffraction which are lowered in proportion to the wavelengths of X-rays. X-ray microscopes which use wavelengths of several hundred angstroms, for example, have merit in that these instruments permit us to expect to obtain resolution as high as 50 nanometers or so and, in addition, the development of compact plasma light sources which emit lasers having high luminance has accelerated the development of X-ray microscopes for laboratory use. Under these circumstances, X-ray microscopes are now regarded as excellent microscopes which are to be used in the future.

Further, attention is now being concentrated on X-ray microscopes using soft X-rays, i.e., soft X-ray microscopes, in addition to the X-ray microscopes which use the ordinary X-ray wavelength.

The soft X-ray microscopes feature merits in that they permit microscopy with resolution higher than that available with the optical microscopes, and in that they do not require, unlike electron microscopes, any pretreatment of samples to be observed. Moreover, since soft X-rays damage biological samples far less than electron beams, these rays are applicable to microscopes for observing biological samples with high resolution and in a non-colored state or in conditions where the samples are kept nearly in their living conditions as the occasion demands.

On the other hand, research is now being actively conducted for the utilization of soft X-rays which are within the so-called "window of water" region (soft X-rays having wavelengths within a range from 23 Å to 44 Å) since it has been clarified that biological samples can be observed in nearly living conditions thereof when soft X-rays within this region are used.

Now, description will be made of conventional examples of operating principles and configurations of soft X-ray microscopes with reference to FIG. 2, FIG. 3 and FIG. 4.

In the case of an imaging type soft X-ray microscope M which is illustrated in FIG. 2, a sample S to be observed contained in a sample vessel V is irradiated with soft X-rays which are emitted from a soft X-ray source LS and condensed by a condenser lens C, and a transmission image of the sample is imaged for detection by an objective lens O on a detector D. Since soft X-rays are absorbed remarkably by air, or have very low transmittance through air, a passage for the soft X-rays must be kept under vacuum and all members from the soft X-ray source LS to the detector D must be accommodated in a vacuum chamber VC. (A soft X-ray microscope of this type will hereinafter be referred to as a vacuum enclosed type.)

Further, a soft X-ray microscope of a type illustrated in FIG. 3 is used for microscopy of biological samples which cannot be kept under vacuum. In the case of this type of soft X-ray microscope, the vacuum chamber is divided into two vacuum chambers: a vacuum chamber $VC_1$ which accommodates a section including the members from the soft X-ray source LS to the condenser lens C and has an exit window $W_1$ disposed on an exit end face of this section; and another vacuum chamber $VC_2$ which accommodates another section including members from the objective lens O to the detector D and has an entrance window disposed on an entrance end face of this section. A sample to be observed S contained in a sample vessel V is placed in a space d which is reserved so as to be as narrow as possible between the exit window emergence $W_1$ and the entrance window $W_2$ of the vacuum chambers $VC_1$ and $VC_2$ respectively that is, in a space AS which is opened to an atmosphere. (A soft X-ray microscope of this type will hereinafter be referred to as an atmosphere-open type.) In this type of soft X-ray microscope, the sample to be observed S is irradiated with soft X-rays which are emitted from the soft X-ray source LS and condensed by the condenser lens C, and emerge through the exit window $W_1$. Soft X-rays which have transmitted through the sample to be observed S are received through the entrance window $W_2$ and a transmission image of the sample S is imaged for detection by the objective lens O on the detector D.

When a sample, in particular a biological sample, is to be observed while it is kept in a wetted condition or while avoiding a drying of the sample under vacuum by using the soft X-rays, types of configurations of sample vessels applicable to the microscopy are different depending upon whether a soft X-ray microscope to be used is the vacuum enclosed type or the atmosphere-open type. When a soft X-ray microscope of the vacuum enclosed type is to be used for the microscopy, the sample to be observed must be kept in water under vacuum. In this case, the sample vessel V is configured so as to contain the sample to be observed S together with an aqueous solution AQ within an internal space IS which is reserved by forming two thin films F on a front surface and a rear surface of a relatively thin sample holding base plate B prepared so as to form the internal space. When a soft X-ray microscope of the atmosphere-open type which has a sample holding space open to atmosphere is to be used for the microscopy, it is unnecessary to form the thin films F on the sample base plate B, but it is sufficient to hold the sample to be observed S and the aqueous solution AQ in an internal space of the sample vessel V. As is judged from the fact described above that the soft X-rays are absorbed by an air layer formed in the sample holding space, however, it is necessary to configure the sample vessel so as to be capable of keeping the sample holding space under a pressure as low as possible.

Furthermore, FIG. 5 exemplifies a sample vessel which has been conventionally proposed. (See Japanese Patent Preliminary Publication No. Sho 63-298200.) This sample vessel V is configured as a pair of structures each of which consists of a silicon base plate SB and a thin film of silicon nitride F approximately 0.3 μm thick formed on one surface of the silicon base plate SB, for example, by CVD method, and has an opening W which is to be used as an entrance window or an exit window and formed by anisotropically etching the other surface of the silicon base plate SB. A sample accommodating chamber CH is formed by cementing a spacer SP made of a material containing silicon and having a predetermined thickness to a surface of the thin film of silicon nitride F of one of the structures with a bonding agent containing silicon. Water containing biological samples is accommodated in the sample accommodating chamber CH and a surface of the thin film of silicon nitride F of the other structure is cemented to the spacer SP by using the same bonding agent so as to enclose the water containing the biological samples. The sample vessel V which has accommodated the water containing the biological samples and the sealed sample accommodating chamber as described above is set in a vacuum chamber and evacuated to a predetermined pressure when the vacuum enclosed type soft X-ray microscope is to be used for the microscopy. When the latter atmosphere-open type of soft X-ray microscopy is to be used, in contrast, the sample vessel is set in a space reserved between the exit window and the entrance window of the vacuum chambers preliminarily evacuated to predetermined pressure levels before effecting the microscopy using soft X-rays.

Each of the conventional sample vessels described above has a defect in that it allows the biological sample enclosed together with water to move freely during a period of time between when the sample is set in the microscope to when the microscopy starts, and during the observation of the sample. In other words, a slight movement of the biological sample hinders observation in case of X-ray microscopes and soft X-ray microscopes which have visual fields which are not as broad. The conventional sample vessels have a common defect in that they can hardly allow observation of a specific sample continuously for a long time since biological samples are moved due not only to convection of the water itself containing the biological samples, and activities of the cells of the biological samples, but also gravity and buoyancy applied to the biological samples in postures thereof.

On the other hand, even the soft X-rays which are within the "window of water" (a soft X-ray having a wavelength of 40 Å, for example) exhibits a transmittance of the order of 14% for a water layer 5 μm thick, for example, which is not so high. It is therefore more advantageous to prepare a sample vessel so as to set a layer of an aqueous solution containing a biological sample thinner (in a direction in which soft X-rays transmit therethrough), but it is more difficult to prepare a sample vessel which sets a thinner layer of an aqueous solution. Overall transmittance is made very low when the sample vessel for the vacuum enclosed type soft X-ray microscope is applied with no modification to the atmosphere-open type soft X-ray microscope in which soft X-rays pass through at least one air layer formed between the exit window $W_1$ and the entrance window $W_2$ of the vacuum chambers $VC_1$ and $VC_2$ on respectively. Even in a case where the soft X-rays which are within the "window of water" region are to be used for microscopy, a problem lies in how the sample to be observed S and the aqueous solution AQ are held relative to the internal space IS when the thin films F sandwiching the sample holding base plate B are omitted in the sample vessel V.

Moreover, use of the sample vessel illustrated in FIG. 5 poses a problem which is described below. When a soft X-ray microscope adopts a white light source and a solid detector such as CCD's, the super-thin films which contain silicon and are used for composing the sample vessel allow transmission also of the visible rays and the detector detects the visible rays in addition to the desired soft X-rays, whereby the microscope cannot provide a microscopic image formed with the desired soft X-rays. In addition, when an X-ray source is a plasma light source emitting a laser, the sample vessel may be damaged by particles flying from the light source.

SUMMARY OF THE INVENTION

Objects of the present invention which have been made in view of the circumstances described above are as follows. That is, the first object of the present invention is to provide a sample vessel for X-ray microscopes which permits easily locating a sample to be observed within narrow visual fields of the X-ray microscopes for a long time.

The second object of the present invention is to provide a sample vessel which eliminates not only the visible rays but also rays having wavelengths longer than those of soft X-rays before incidence onto a detector and has reinforce super-thin films.

In order to attain the primary object of the present invention described above, the sample vessel for X-ray microscopes according to the present invention comprises a first member having an entrance window allowing transmission of at least X-rays, a second member having an exit window disposed in opposition to the entrance window, a spacer which is disposed between the first member and the second member so as to form a space for enclosing samples to be observed therein, and a mesh member disposed within the space for the samples for limiting movements of the samples to be observed.

In order to attain the second object of the present invention, the sample vessel for X-ray microscopes according to the present invention has an entrance window coated with a metal material.

In a preferred formation of the present invention, the mesh member is formed by braiding, into a mesh-like form, a wire material which is made of a substance forming at an angle of contact smaller than 90° at ambient temperature relative to an aqueous solution enclosed together with samples to be observed in the space described above. Owing to the form of the mesh member, a water film which sustains itself due to surface tension is formed in each mesh and a sample is held in this water film. The wire material is one of metal such as nickel, a high molecular compound polymer or an inorganic compound. Further, the mesh member is formed so as to be freely put and taken into and out of the space described above.

In the sample vessel for X-ray microscopes according to the present invention, the first member comprises a base plate having an opening of incidence matched with a window which forms an entrance window and a thin film disposed between the base plate and the space mentioned above. The thin film is coated with a metal material. This metal coating enhances mechanical strength of the window of incidence, serves for preventing damage of the sample vessel by particles flying from light sources even when a plasma light source emitting a laser is used and can lower the possibility of breakage of the window due to pressure differences.

These and other objects as well as the features and the advantages of the present invention will be apparent from the following detailed description of the preferred embodiments to be referred to in conjunction with the accompanying drawings.

BRIEF DESCRIPTION OF THE DRAWINGS

FIGS. 1B(1) and 1B(2) are diagrams illustrating another conventional X-ray microscope using a Fresnel zone plate;

DESCRIPTION OF THE PREFERRED EMBODIMENTS

Figure 6A:
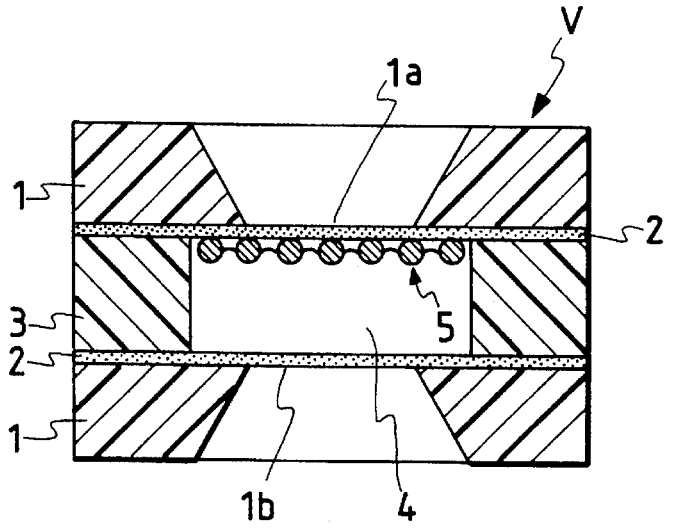
FIG. 6A is a schematic sectional view illustrating a first embodiment of the sample vessel for X-ray microscopes according to the present invention.
Figure 6B:
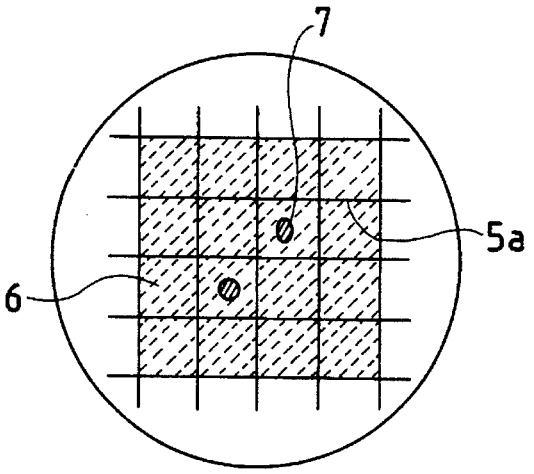
FIG. 6B is a plan view illustrating, on an enlarged scale, a metal mesh member to be used in the first embodiment of the sample vessel according to the present invention.
Figure 6C:
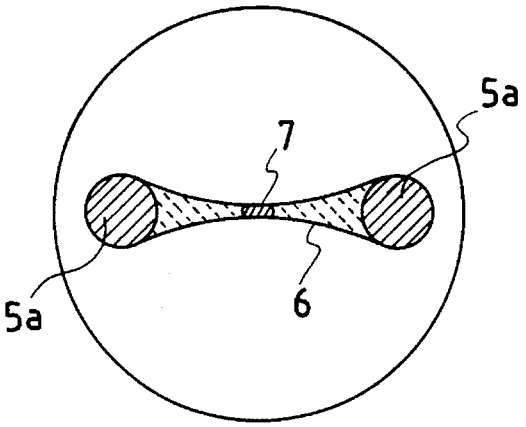
FIG. 6C is a sectional view illustrating, on an enlarged scale, a water film formed in a unit section of the metal mesh member used in the first embodiment of the present invention.

The sample vessel illustrated in FIG. 6A and preferred as the first embodiment of the present invention is structured in the following procedures. The sample vessel is first configured as a pair of structures each of which consists of a silicon base plate 1 having an opening 1*a* or 1*b* and a thin film of diamond 2 integrated with the base plate 1. This structure is configured by forming, on one surface of the silicon base plate 1, the thin film of diamond 2 approximately 0.3 μm thick, for example, by an evaporation-coating method and anisotropically etching a central portion of the base plate 1 from the side of the other surface thereof so as to form an opening to be used as an entrance window or an exit window including a central portion of the thin film of diamond 2. In the case of the first embodiment, a sample holding member accommodating space 4 is formed by bonding a spacer 3 which is made of a material containing silicon and has predetermined thickness to a surface of the thin film of diamond 2 of the one of the structures disposed on the side of the soft X-ray source by using a bonding agent containing silicon and disposing a metal mesh member 5 which is made of nickel wires having a diameter of approximately 0.3 mm at pitches of a 25 μm for use as a sample holding member in contact with the thin film of diamond 2 as shown in FIG. 6B. By adequately dripping an aqueous solution over the metal mesh member 5 made of the nickel wires which is disposed in contact with the thin film of diamond 2 in the sample holding member accommodating space 4, a water film 6 which holds itself due to surface tension is easily formed in each unit mesh enclosed by the nickel wires 5*a* as shown in FIG. 6B and FIG. 6C. (The water film has free surfaces which are concave due to the surface tension as shown in FIG. 6C.) After setting a biological sample 7 into the water film 6, a surface of the thin film of diamond 2 of the other structure is cemented to the spacer 3 with the bonding agent so as to enclose the biological sample and the aqueous solution.

The sample vessel thus obtained is effectively usable as a sample vessel which accommodates the biological sample to be subjected to microscopy with the vacuum enclosed type of X-ray microscopes. That is to say, the sample vessel preferred as the first embodiment of the present invention is capable of favorably limiting a shift of the biological sample 7 to be observed and remarkably facilitates observation of the sample since the sample vessel is configured so as to permit forming the water film 6 which holds itself due to the surface tension within each mesh enclosed by the nickel wires 5*a*, or within a limited narrow sample accommodating space, and sustains the biological sample in the water film 6. Further, this sample vessel has mechanical strength enhanced sufficiently to withstand bombardment with particles flying from the X-ray source and lowers the possibility of breakage due to pressure differences between both sides of the window of incidence, because the opening 1*a* which is the window of incidence of the soft X-rays is provided with the thin film of diamond 2 reinforced by the metal mesh member 5 made of nickel.

Figure 7A:
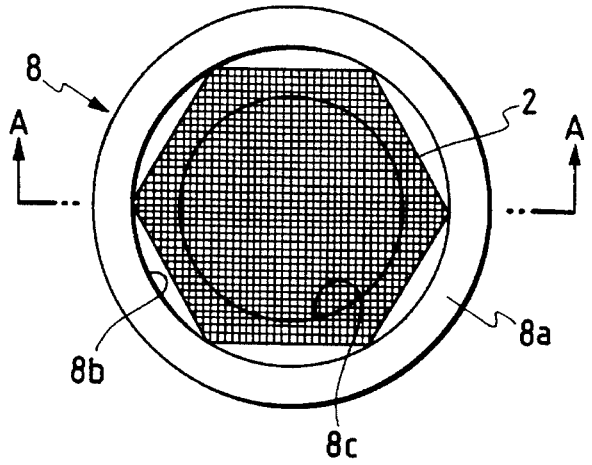
FIG. 7A is a plan view illustrating a state of a thin film of water sustained by the metal mesh member.
Figure 7B:
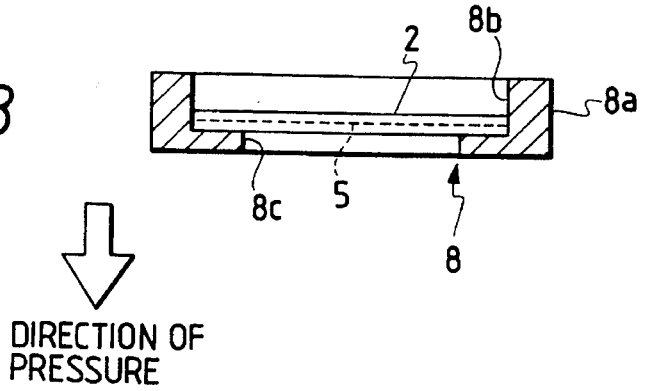
FIG. 7B is a sectional view taken along line an A—A in FIG. 7A.

Now, detailed description will be made of the sample holding member which is composed of the metal mesh member 5 and the thin film of diamond 2 used in the first embodiment. In FIG. 7A and FIG. 7B, the reference numeral 8 represents a ring-shaped holder which has an internal holding space 8*b* enclosed by an outer frame 8*a* and a central opening to be used as a transmission window 8C. Disposed in this holding space 8*b* is the metal mesh member 5 approximately 0.3 mm thick which is made of the metal wires braided in the mesh-like form and which is to be used as a sample holding member. By covering an upper surface of the metal mesh member 5 with the thin film of diamond 2 approximately 1 μm thick, the thin film of diamond 2 which is reinforced with the metal mesh member 5 can be obtained. This thin film of diamond 2 is capable of withstanding a differential pressure on the order of 1 atmospheric pressure even when the thin film has, for example, an effective opening of several millimeters (6 mm in FIG. 7A).

It is known that water molecules contained in aqueous solutions to be used in combination with biological samples have high polarization characteristics and the aqueous solutions form small angles of contact with substances other than organic compounds containing carbon, and are adsorbed sufficiently effectively to and by surfaces of the substances. Accordingly, a water film which holds itself due to the surface tension is formed in each of the meshes enclosed by the metal wires when the metal mesh member 5 is brought into contact with water. Therefore, the water film has curved surfaces and holds a biological sample after the metal mesh member 5 holding the thin film of diamond 2, the one shown in FIG. 7A in particular, is brought into contact with water and excessive water is wiped off. By utilizing this phenomenon, it is possible to hold an aqueous solution containing a sample to be observed, for example a biological sample, within a very narrow space of each mesh.

Figure 8:
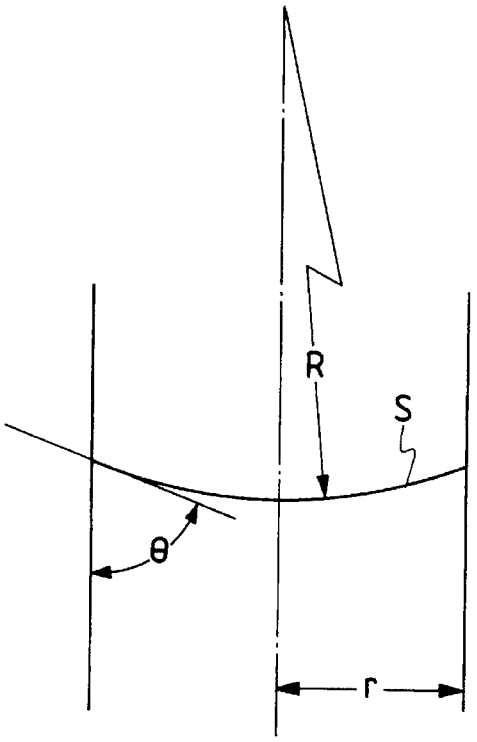
FIG. 8 is a diagram descriptive of an angle of contact with a water film formed on the metal mesh member.

Under the present circumstances, there is available no theoretical formula which defines the way in which an angle of contact θ with determines behavior of the water which is placed in the space enclosed by the metal wires of the mesh member. Therefore, let us approximate the space enclosed by the metal wires of the mesh member to a well-known cylindrical space which is shown in FIG. 8 and examine the angle of contact θ with the water film having the curved surfaces described above. When a radius of curvature of a curved surface S is represented by R and a diameter of the cylindrical space which corresponds to a pitch of meshes is designated by 2r, we obtain a relationship expressed by the following formula:

$$\cos\theta = r/R$$

R used in this formula has a positive value when the curved surface S is concave as shown in FIG. 8 or a negative value when the curved surface S is convex. Accordingly, when the angle of contact θ with water is smaller than 90°, cos θ is larger than 0 and the curved surface S is concave, whereby a required water film is formed so as to hold a biological sample therein. When the angle of contact θ with water is equal or larger to or than 90°, on the other hand, it will be understood that cos θ is equal to or smaller than 0 and the curved surface S is convex or planar, whereby the required water film cannot be formed. That is to say, it is impossible to hold an aqueous solution containing a biological sample in each mesh when the angle of contact θ with water is equal to or larger than 90°.

Further, since the metal mesh member 5 for reinforcing and holding the thin film of diamond 2 can be braided at a minimum pitch on the order of 20 μm, it is possible to enclose an aqueous solution containing a biological sample within a narrow space of a mesh measuring 20 μm×20 μm so that the biological sample can be easily observed continuously for a long time with no slight shift. Furthermore, since the metal mesh member 5 has an effect to reinforce the sample vessel 8 itself, the metal mesh member 5 makes it possible to manufacture X-ray windows which are strong and thin enough not to attenuate X-rays.

As is understood from the foregoing description, the metal mesh member which is made of the nickel wires in the first embodiment may be made of other metals which are excellent in affinity with water, or still other materials which are excellent in affinity with water, for example, high molecular compounds such as acrylic resin, rayon and nylon or inorganic compounds containing silicon. Moreover, regarding the disposition of the metal mesh member in the space 4 for the biological sample 7 in the sample vessel V, the thin film of diamond 2 reinforced by the mesh member 5 may be disposed for the opening 1*a* to be used as the entrance window as described above and a thin film of silicon nitride may be disposed for the opening 1*b* to be used as the exit window, or vice versa.

Figure 9A:
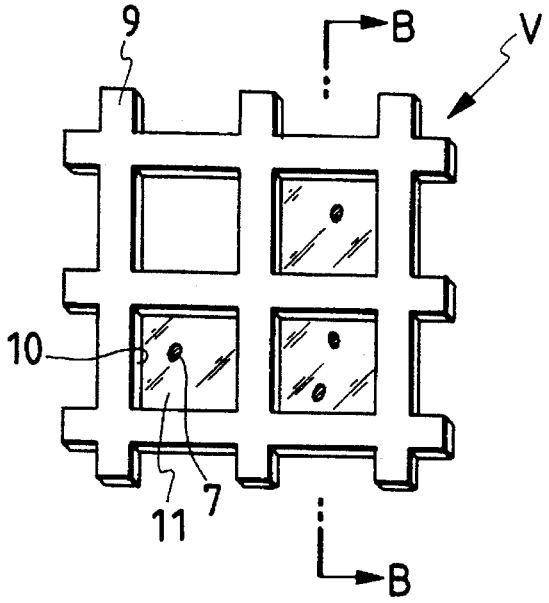
FIG. 9A is a schematic perspective view illustrating a second embodiment of the sample vessel for X-ray microscopes according to the present invention.
Figure 9B:
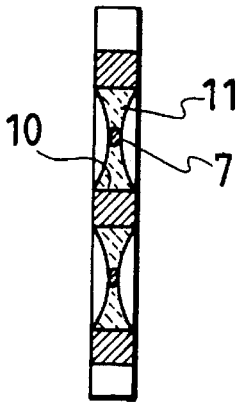
FIG. 9B is a sectional view taken along line a B—B in FIG. 9A.

In the second embodiment of the present invention illustrated in FIG. 9A, a sample vessel V is formed by disposing, at a pitch of 100 μm, a plurality of sample accommodating spaces 10 consisting of small openings measuring 50 μm×50 μm which are bored in a thin sample holding base plate 9 made of a copper sheet approximately 5 μm thick and regularly arranged at a pitch of 100 μm. By dripping an aqueous solution adequately into the sample accommodating spaces 10, it is possible to form water films 11 which can hold themselves due to the surface tension (free surfaces of the water films are held in curved conditions due to the surface tension in FIG. 9B) and sustain a biological sample 7 in each of the water films 11.

The sample vessel V prepared as described above is usable with no modification as a sample vessel in particular for the atmosphere-open type X-ray microscopes without tightly sealing the water films 11, or with the water films 11 containing the biological samples 7 kept exposed to air, and under no restriction to postures of the biological samples. Accordingly, the sample vessel preferred as the second embodiment of the present invention is also capable of desirably restricting a shift of the biological samples 7 to be observed and facilitates microscopy of the samples since the sample vessel is configured so as to permit forming a water film 11 in each unit sample accommodating space 10 owing to the surface tension, and holding the biological sample 7 in this water film 11.

Figure 10A:
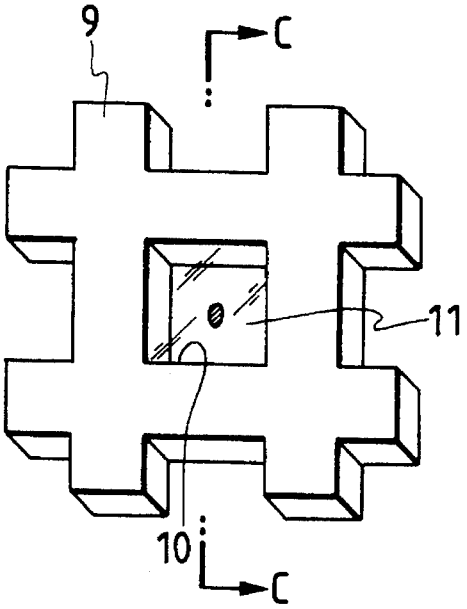
FIG. 10A is a perspective view illustrating, on an enlarged scale, a unit section of the sample vessel used in the second embodiment of the present invention.
Figure 10B:
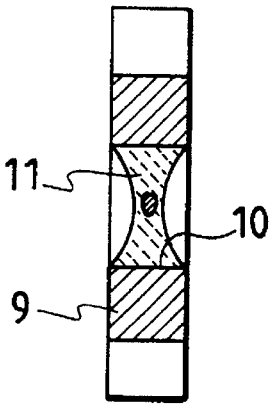
FIG. 10B is a sectional view taken along line C—C in FIG. 10A.

FIG. 10A and FIG. 10B show a modification of the second embodiment of the present invention which is configured so as to have only one sample accommodating space 10. When a material of the sample holding base plate 9 as well as a size and depth (thickness of the base plate) of the accommodating space 10 is adequately selected, this modification also permits forming the water film 11 thinner than the base plate 9 and facilitates observation of a biological sample with no influence due to set posture of the sample vessel V.

Figure 1A:
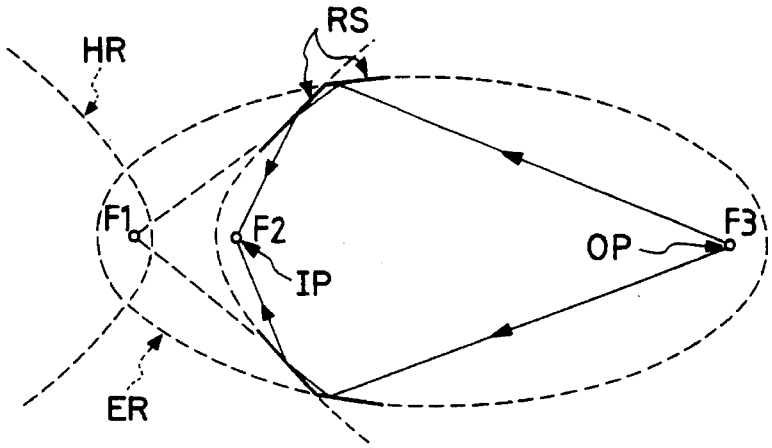
FIG. 1A PRIOR ART
FIG. 1A is a diagram illustrating a conventional X-ray microscope using a Walter type grazing incidence optical system.
Figure 1A:
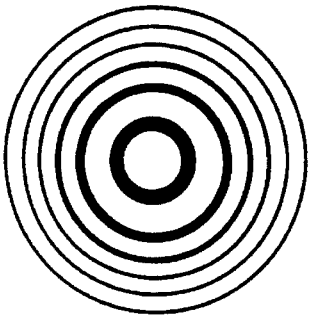
FIG. 1A PRIOR ART
Figure 1A:
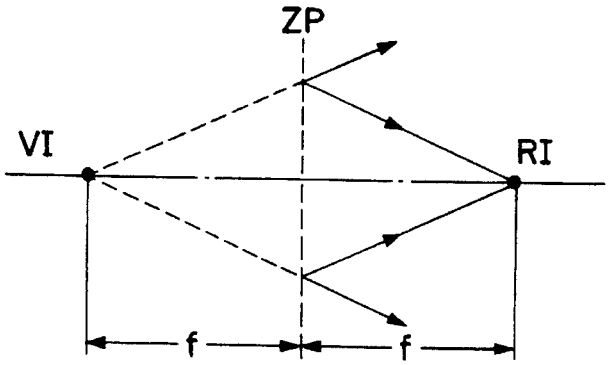
FIG. 1A PRIOR ART
Figure 1C:
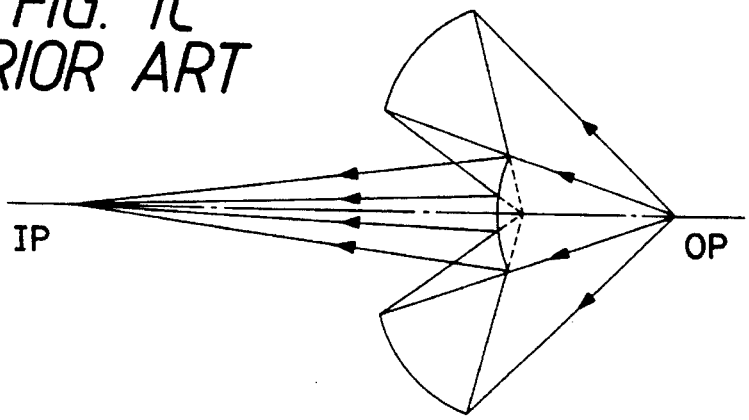
FIG. 1C PRIOR ART
FIG. 1C is a diagram illustrating still another X-ray microscope using a direct incidence type Schwarzschild optical system.
Figure 2:
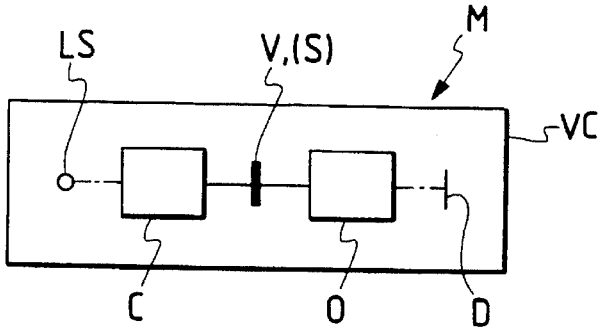
FIG. 2 PRIOR ART
FIG. 2 is a schematic view illustrating a fundamental configuration of a general vacuum enclosed type of soft X-ray microscope.
Figure 3:
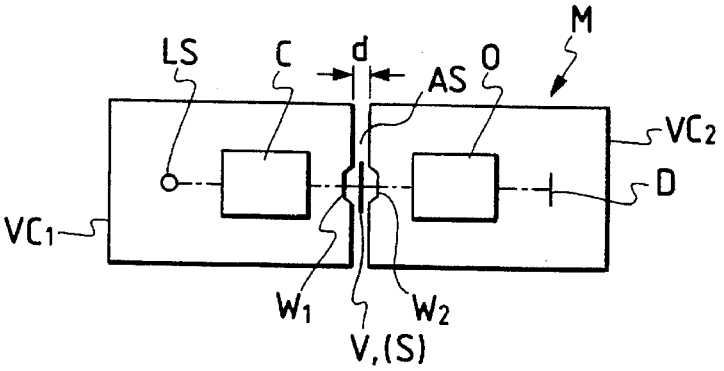
FIG. 3 PRIOR ART
FIG. 3 is a schematic view illustrating a fundamental configuration of a general atmosphere-open type soft X-ray microscope.
Figure 4:
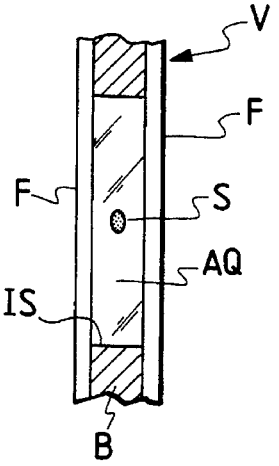
FIG. 4 PRIOR ART
FIG. 4 is a sectional view illustrating a conventional example of sample vessels to be used with the vacuum enclosed type soft X-ray microscopes.
Figure 5:
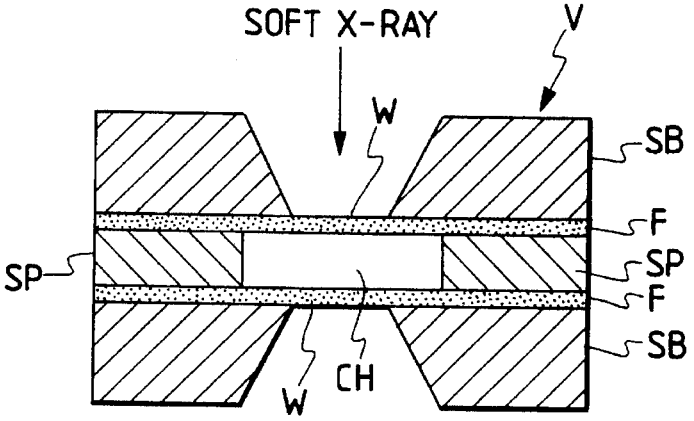
FIG. 5 PRIOR ART
FIG. 5 is a sectional view illustrating another conventional example of sample vessels to be used with X-ray microscopes.
Figure 11:
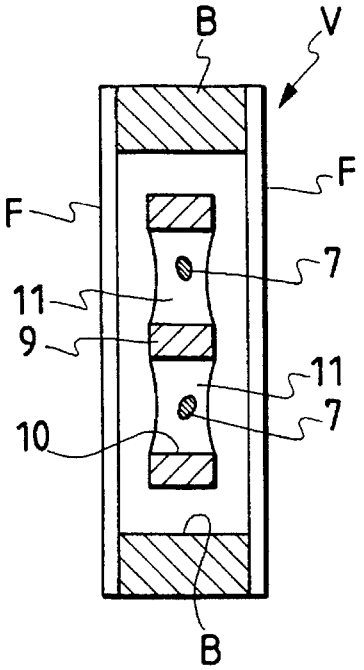
FIG. 11 is a sectional view illustrating a modificational use of the sample vessel adopted for the second embodiment of the present invention.
Figure 12:
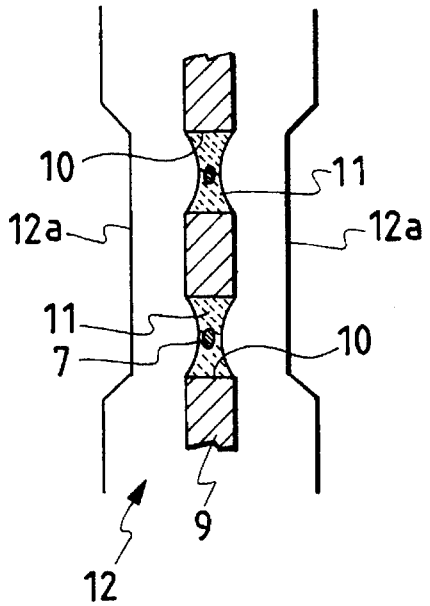
FIG. 12 is a sectional view illustrating a modificational use of the sample vessel adopted for the second embodiment of the present invention.

When the sample vessel preferred as the second embodiment is to be used with the vacuum enclosed type X-ray microscopes, it is sufficient to use the sample vessel V shown in FIG. 4 in a condition where it accommodates the sample holding base plate 9 and sustains the water films 11 containing the biological samples 7 as illustrated in FIG. 11 or to adopt a sample chamber 12 having openings 12*a* such as the entrance window and the exit window in a condition which where sustains water films 11 containing biological samples 7 in the sample holding spaces 10.

Though the sample holding base plate is made of a copper sheet in the second embodiment described above, the sample holding base plate may be made of other metals excellent in affinity with water, or still other materials which similarly are excellent in affinity with water, for example, high molecular compounds such as acrylic resin, rayon and nylon, or inorganic compounds containing silicon.

Figure 13:
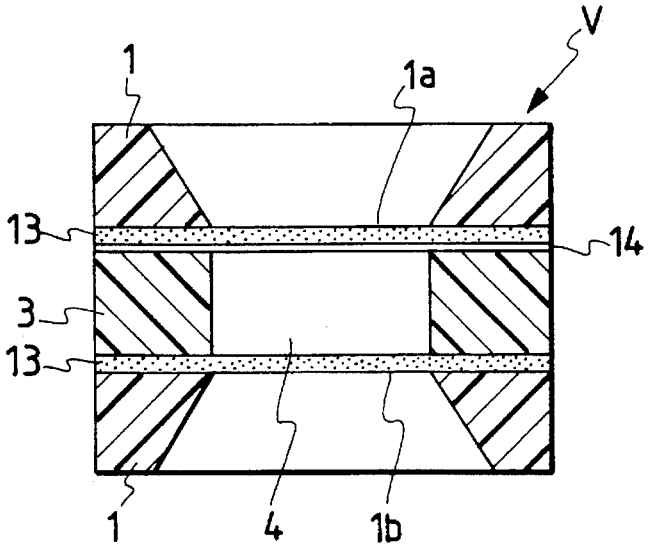
FIG. 13 is a schematic sectional view illustrating a third embodiment of the sample vessel for X-ray microscopes according to the present invention.

FIG. 13 illustrates the third embodiment of the sample vessel according to the present invention. The third embodiment is different from the first embodiment illustrated in FIG. 6A in that the sample vessel preferred as the third embodiment uses a thin film of silicon nitride 13 approximately 0.3 μm thick formed on one surface of the silicon base plate 1 by CVD method and a thin film of aluminium 14 approximately 0.1 μm thick is laminated over the thin film of silicon nitride 13 on the side of the opening of the entrance window 1*a*. The sample vessel preferred as the third embodiment can be manufactured in procedures described below. After forming the thin film of silicon nitride 13 as described above, portions to be used as an entrance window 1*a* and an exit window 1*b* are removed from the thin film of silicon nitride 1 so as to form a pair of structures consisting of a thin film of silicon nitride 13-silicon base plate 1 and a thin film of silicon nitride 13-silicon base plate 1 respectively. Further, aluminium is evaporation-coated so as to form a thin film of aluminium approximately 0.1 μm thick over the thin film of silicon nitride 13 of the structure consisting of the thin film of silicon nitride 13-silicon base plate 1 which is disposed on the side of the entrance window 1*a*. After disposing a wetted biological sample in a portion corresponding to an internal space 4 in which the biological sample is to be enclosed, a spacer 3 is cemented to the integrated structures by using a bonding agent containing silicon. The end surfaces which are in parallel with the paper surface are sealed with a sealing agent containing silicon as the occasion demands.

According to Japanese Patent Application No. Hei 4-58040, which was laid open on Oct. 12, 1993, as publication No. Hei 5-2647398 a thin film of aluminium 0.1 μm thick exhibits transmittance of 0.53 for a ray having a wavelength of 39.81 Å. Since the thin film of aluminium 0.1 μm thick exhibits a transmittance of $2.3\times10^{-7}$ for the visible ray, on the other hand, this thin film is usable as an ideal filter when solid detectors such as CCD's are used as detectors for X-ray microscopes. Since the sample vessel preferred as the third embodiment of the present invention has the exit window 1*b* (the window disposed on the side of the detector) which is transparent for the visible ray, the sample vessel permits observing biological samples with the visible ray. Though aluminium is evaporation-coated so as to form a thin film of aluminium approximately 0.1 μm thick over the thin film of silicon nitride 13 of the integrated structure of the thin film of silicon nitride 13-silicon base plate 1 disposed on the side of the light source in the third embodiment, the coating metal is not limited to aluminium but may be any metal which reflects or absorbs the visible ray and ultraviolet ray, and allows transmission of X-rays.

Though the sample vessel preferred as the third embodiment is structured by using the spacer 3 made of the material containing silicon, a material of the spacer is not limited to that containing silicon and may be any one of those which are not affected by vacuum.

What is claimed is:

1. A sample vessel for X-ray microscopes comprising:

a first member having an entrance window allowing transmission of x-rays therethrough, a second member having an exit window disposed to oppose said entrance window, each of said entrance window and said exit window being covered with a thin film which allows transmission of said X-rays therethrough and which is impermeable to air, a sample holding member having a mesh form, said sample holding member limiting movement of a sample to be observed, in a direction parallel to a surface of said sample holding member when said sample to be observed is placed in contact with said mesh form so as to be within a plurality of unit mesh openings thereof, and a spacing member which is disposed between said first member and said second member to form a sample holding member accommodating space for containing said sample holding member between said entrance window and said exit window.

2. A sample vessel for X-ray microscopes according to claim 1, wherein said sample holding member is formed with a wire material which makes an angle of contact with water smaller than 90° at an ambient temperature.

3. A sample vessel for X-ray microscopes according to claim 1, wherein said first member comprises a base plate having an opening which forms said entrance window, and said thin film which covers said entrance window, disposed between said base plate and said sample holding member accommodating space.

4. A sample vessel for X-ray microscopes according to claim 3, wherein said thin film covering said entrance window is coated with a metal for reinforcing said entrance window.

5. A sample vessel for X-ray microscopes comprising:

a first member having an entrance window allowing transmission of X-rays therethrough, a second member having an exit window disposed to oppose said entrance window, each of said entrance window and said exit window being covered with a thin film which allows transmission of said X-rays therethrough and which is impermeable to air, a sample holding member formed of a wire material and having a mesh form, said sample holding member limiting movement of a sample to be observed, in a direction parallel to a surface of said sample holding member when said sample to be observed is placed in contact with said mesh form so as to be within a plurality of unit mesh openings thereof, and said wire material making an angle of contact with water smaller than 90° at an ambient temperature, a spacing member which is disposed between said first member and said second member to form a sample holding member accommodating space for containing said sample holding member between said entrance window and said exit window.

6. A sample vessel for X-ray microscopes according to claim 5, wherein said sample is an aqueous solution which holds itself as a water film in said plurality of unit mesh openings of said sample holding member, said aqueous solution assuming said mesh form by virtue of a surface tension thereof.

7. A sample vessel for X-ray microscopes according to claim 1, wherein said sample is held inside a liquid film, said liquid film being formed confined in each of said plurality of unit mesh openings of said mesh form by virtue of a surface tension of a liquid material of said liquid film containing said sample.

8. A sample vessel for X-ray microscopes according to claim 6, wherein a space is left between said sample holding member having said mesh form and at least one of said thin films covering said entrance window and said exit window.

9. A sample vessel for X-ray microscopes according to claim 7, wherein a space is left between said sample holding member having said mesh form and at least one of said thin films covering said entrance window and said exit window.

10. A sample vessel for X-ray microscopes according to claim 6, wherein a space is left between said water film in said plurality of unit mesh openings of said sample holding member and at least one of said thin films covering said entrance window and said exit window.

11. A sample vessel for X-ray microscopes according to claim 7, wherein a space is left between said liquid film formed confined in each of said plurality of unit mesh openings of said mesh form and at least one of said thin films covering said entrance window and said exit window.

12. A sample vessel for X-ray microscopes according to claim 1, wherein said thin films covering said entrance window and said exit window include a layer of one of diamond and silicon nitride.

13. A sample vessel for X-ray microscopes according to one of claim 2, 8 or 10, wherein said wire material is nickel.

14. A sample vessel for X-ray microscopes according to one of claim 2, 8 or 10, wherein said wire material is a metal.

15. A sample vessel for X-ray microscopes according to one of claim 2, 8 or 10, wherein said wire material is a polymer.

16. A sample vessel for X-ray microscopes according to one of claim 2, 8 or 10, wherein said wire material is an organic compound.

17. A sample vessel for X-ray microscopes according to one of claim 1, 9 or 11, wherein said sample holding member is freely accessible within said sample holding member accomodating space.

18. A sample vessel for X-ray microscopes according to one of claim 2, 8 or 10, wherein said wire material is an inorganic compound.

* * * * *